US006277196B1

(12) United States Patent
Woodman et al.

(10) Patent No.: US 6,277,196 B1
(45) Date of Patent: Aug. 21, 2001

(54) COATING APPARATUS

(75) Inventors: Gwilym Leslie Woodman; David Snell; Philip Beckley, all of Wales (GB)

(73) Assignee: European Electrical Steels, Wales (GB)

( * ) Notice: Subject to any disclaimer, the term of this patent is extended or adjusted under 35 U.S.C. 154(b) by 0 days.

(21) Appl. No.: 09/308,664

(22) PCT Filed: Nov. 28, 1997

(86) PCT No.: PCT/GB97/03274

§ 371 Date: Jul. 21, 1999

§ 102(e) Date: Jul. 21, 1999

(87) PCT Pub. No.: WO98/24557

PCT Pub. Date: Jun. 11, 1998

(30) Foreign Application Priority Data

Dec. 3, 1996 (GB) ..... 9625122

(51) Int. Cl.[7] ..... B05C 1/04

(52) U.S. Cl. ..... 118/211; 118/212; 118/227; 118/236; 118/249; 118/253; 118/261; 118/262

(58) Field of Search ..... 118/211, 212, 118/227, 236, 249, 253, 261, 262, 117, 119, 122, 126

(56) References Cited

U.S. PATENT DOCUMENTS

| | | | | |
|---|---|---|---|---|
| Re. 31,695 | | 10/1984 | Zink | 427/211 |
| 3,568,636 | | 3/1971 | Lockwood | 118/259 |
| 3,987,750 | * | 10/1976 | Knapke | 118/119 |
| 4,231,318 | | 11/1980 | Zink | 118/122 |
| 4,288,492 | | 9/1981 | Hiromae et al. | 428/336 |
| 4,354,449 | | 10/1982 | Zink | 118/126 |
| 4,378,390 | * | 3/1983 | Yoshida et al. | 118/262 |
| 4,485,132 | | 11/1984 | Furuzono et al. | 427/428 |
| 4,949,667 | | 8/1990 | Yoshida et al. | 118/60 |
| 5,336,529 | * | 8/1994 | Schafer | 427/487 |
| 5,755,883 | * | 5/1998 | Kinose et al. | 118/261 |

OTHER PUBLICATIONS

"Raster–und haschurenwalzen hergestellt mittels Lasertechnik", Coating, No. 12, 1995, St. Gallen, CH., pp. 482–485.

* cited by examiner

*Primary Examiner*—Laura Edwards
(74) *Attorney, Agent, or Firm*—Blank Rome Comisky & McCauley, LLP

(57) ABSTRACT

Apparatus for applying a coating of an insulation lacquer to a moving surface of a strip comprises a rotatable roller whose surface defines a multiplicity of cells and a reservoir containing a bath of heated organic/inorganic insulating lacquer in which a part of the roller surface is immersed when rotating. Insulating lacquer enters the cells of the roller surface and excess lacquer is wiped from the roller surface. A rotatable applicator roll having a substantially plain surface free of grooves or other indentations is rotated with its surface in contact with the surface of the lacquer carrying roller whereby lacquer present in the cells of the roller is transferred to the surface of the applicator roll. The surface to be coated is moved continuously past and in contact with the roll surface to apply a uniform coating of lacquer to that surface. The strip is preferably a strip of non-oriented electrical steel.

3 Claims, 4 Drawing Sheets

COATING APPARATUS

BACKGROUND OF THE INVENTION

1. Field of the Invention

This invention relates to coating apparatus for applying a coating of an insulating lacquer to steel strip, especially electrical steel strip. The invention also relates to methods of applying coatings using this apparatus, and to steel strip coated thereby.

2. Description of Related Art

It is known to coat non-oriented electrical steel strip on one or both surfaces with an insulation lacquer in order to improve the performance of the strip when employed, for example, in a magnetic core of an electrical machine; insulation coatings on electrical steel laminations reduce the eddy currents in a stack and hence reduce power losses in the steel.

Certain applications for steel require coatings which are essentially organic in nature and exhibit only reasonably good punchability characteristics. Such coatings, however, exhibit good welding properties. Conversely, other coatings comprise inorganic additives and exhibit excellent welding characteristics but behave poorly when punched. Therefore the coating chosen has to be a compromise to suit the final application required.

U.S. Pat. No. 4,288,492 discloses an electrical steel sheet coated with an insulating lacquer of an organic polymeric material. The thickness of the lacquer coating is less than 10 microns, typically between 1 and 8 microns. U.S. Pat. No. 4,288,492 does not disclose the method by which the coating is applied, other than by reference to the employment of a roll coater. Conventional roll coaters generally comprise a grooved roller which rotates in contact with the surface of a sheet to be coated and applies a controlled pressure thereto. Coatings applied by such rolls tend to be uneven and the grooved rollers themselves are susceptible to damage and blockage because of pick-up resulting in subsequent poor coating of the electrical steel surface. U.S. Pat. No. 4,288,492 also discloses the step of curing the applied coating with ultraviolet rays or electron beams.

It is extremely difficult with conventional electric steel coatings to produce the very thin coatings of uniform thickness required because of the rheology of the applied coating.

In order to be suitable for some methods of application such as the multiple-step kneading roll method, coatings require the lubricity imparted by organic additives. However, high organic solvent based coatings have many disadvantages such as inflammability, the need for expensive after burners for burning off solvent vapour and the need to remove volatile organic compounds.

Other methods of coating such as the pick-up roll method are limited to low speed coating because it is impossible to pick up high viscosity liquids onto the pick-up roll. This method has further disadvantages, for example, the thickness of the resulting coating becomes irregular if there are any variations in the coating speed.

A system for applying coatings to substrates using a roller having an engraved surface is shown in "Raster- und Haschurenwalzen hergestellt mittels Lasertechnik" in COATING 12/95, St. Gallen CH, and means for heating the substrate and apparatus to lower the viscosity of the lacquer is shown in U.S. Pat. No. 4,949,667.

SUMMARY OF THE INVENTION

The applicants have now established that by means of this invention a relatively thin coating of an organic or organic/inorganic high viscosity insulating lacquer of uniform thickness can be applied consistently at high speeds, to one or both surfaces of electrical steel strip moving continuously between, for example, an uncoiler and a coiler, without the addition of thinning agents to the coating lacquer.

According to the present invention in one aspect there is provided apparatus for applying a coating of an insulation lacquer to a moving surface of a steel strip, the apparatus comprising a rotatable metering roller whose surface defines a multiplicity of cells, a reservoir connected to receive controlled quantities of organic or organic/inorganic insulating lacquer from a source of such lacquer, means for controlling the temperature of the lacquer resident in the reservoir, means for immersing a part of the roller surface in a bath of insulating lacquer resident in the reservoir to cause insulating lacquer to enter the cells of the roller surface, means for wiping excess lacquer from the roller surface means for imparting rotation to the roller, a rotatable applicator roll having a substantially plain surface free of grooves or other indentations, means for rotating the applicator roll with its surface in contact with the surface of the lacquer carrying metering roller or an intermediate lacquer carrying transfer roller whereby lacquer present in the cells of the metering roller is transferred to the surface of the applicator roll, and means for moving the surface to be coated continuously past and in contact with the applicator roll to apply a continuous uniform coating of lacquer to that surface, and means for controlling the temperature of the lacquer in the reservoir before it is transferred to the metering roller.

One or more intermediate transfer rollers may be positioned between the lacquer carrying roller and the applicator roller.

A set of smoothing rollers may be positioned downstream of the applicator roll, the smoothing rollers applying limited pressure to the lacquer coated strip.

The strip is preferably a strip of non-oriented electrical steel.

The lacquer is preferably heated to between 40° C. and 50° C.

The lacquer may be UV curable, a drying chamber including UV lamps being positioned downstream of the applicator roll to cure the applied coating.

The invention will now be described by way of example only with reference to the accompanying diagrammatic drawings

BRIEF DESCRIPTION OF THE FIGURES OF DRAWINGS

Figure 3:
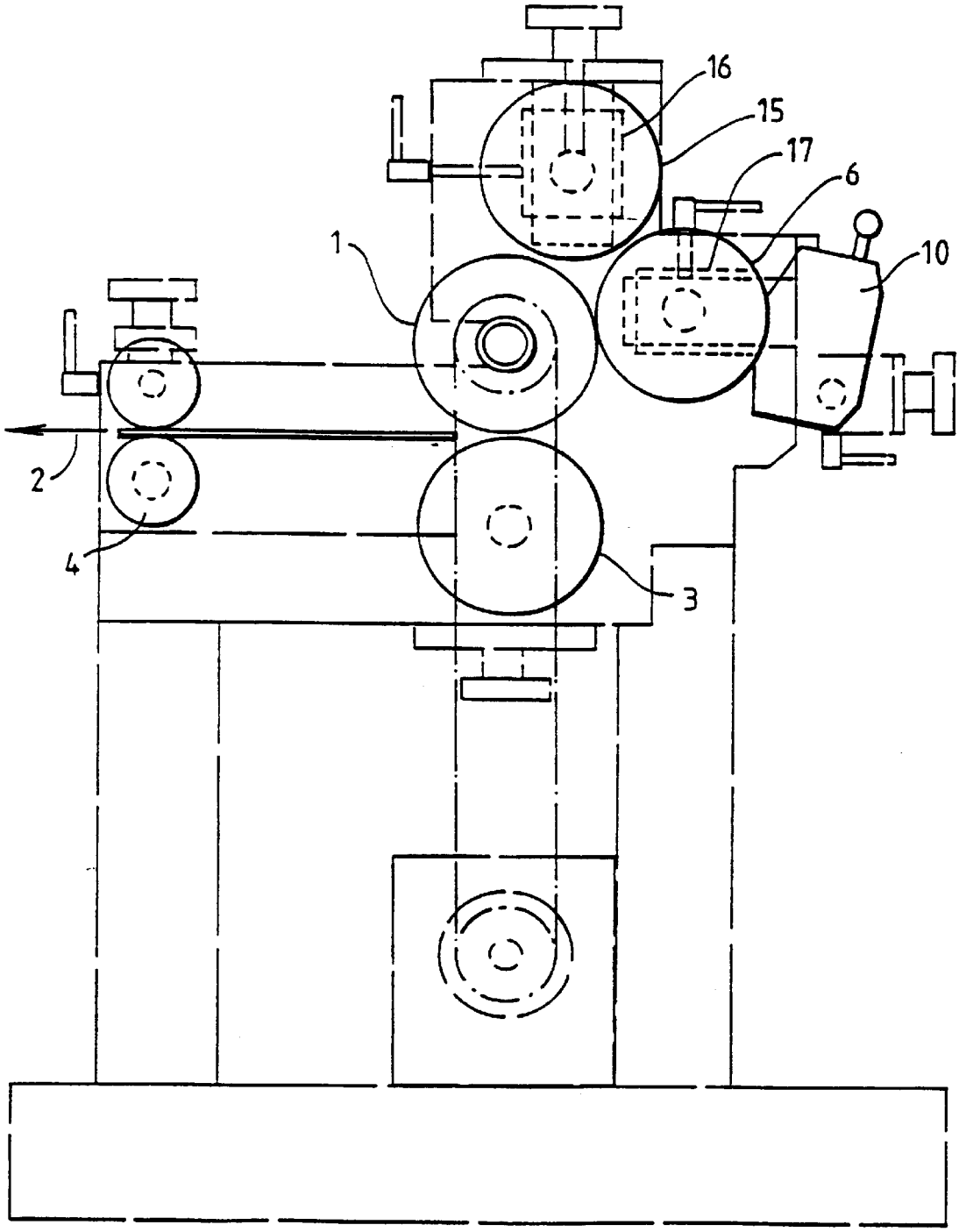
Figure 4:
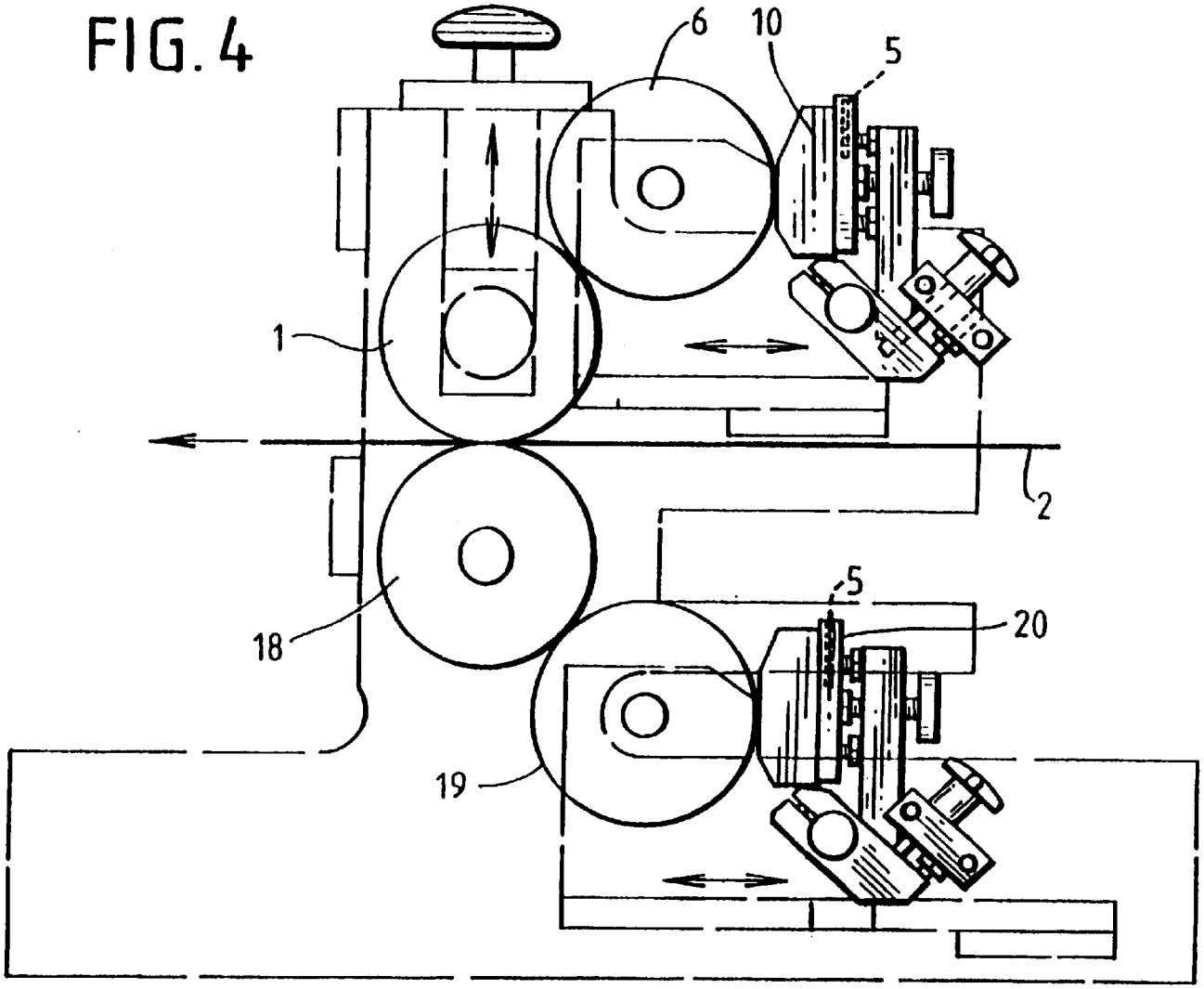
Figure 5:
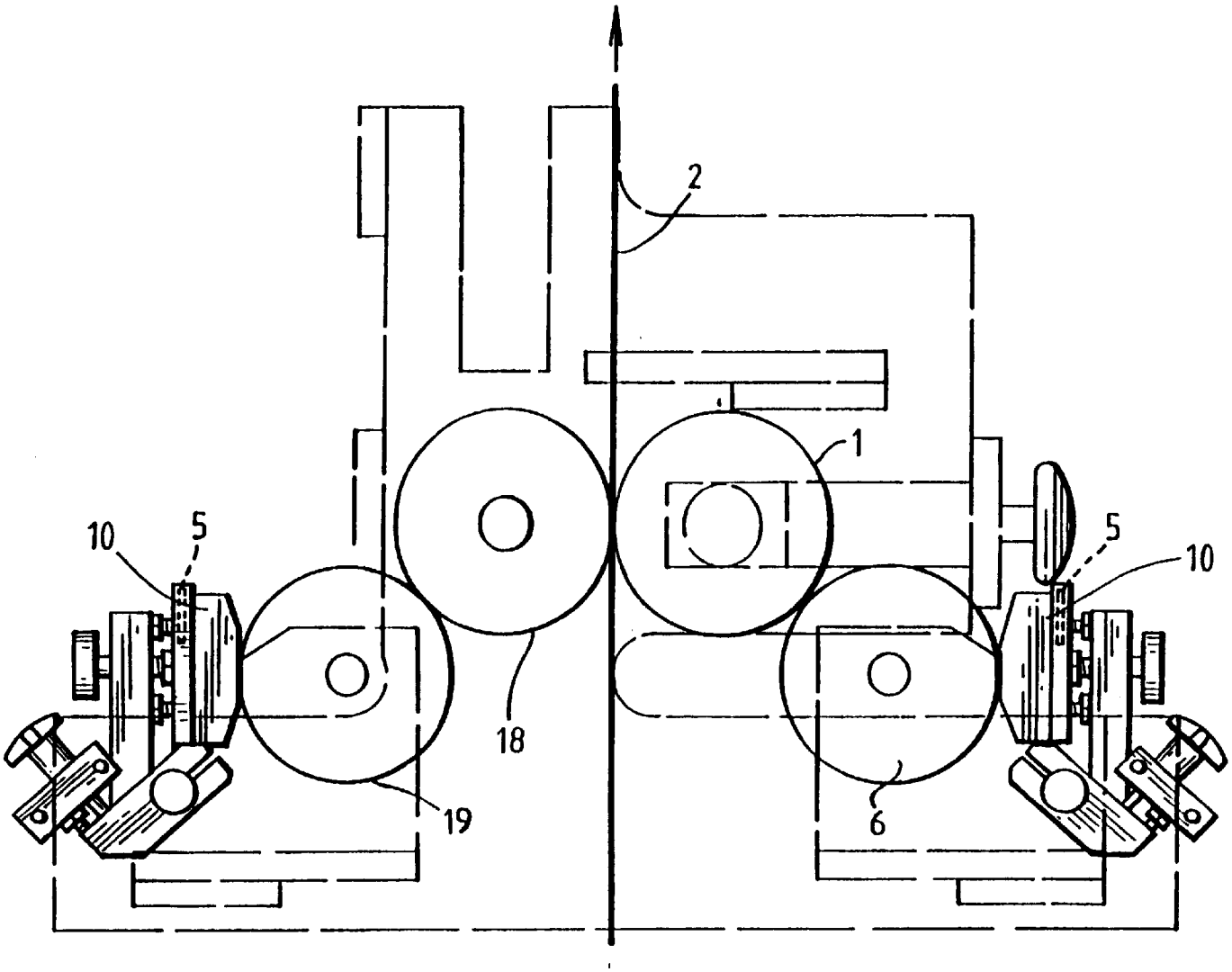

FIG. 3 schematically illustrates an alternative coating apparatus in accordance with the invention;

FIG. 4 is a side view of further coating apparatus in accordance with the invention; and FIG. 5 is a side view of still further coating apparatus in accordance with the invention.

DETAILED DESCRIPTION OF THE PREFERRED EMBODIMENT

Figure 1:
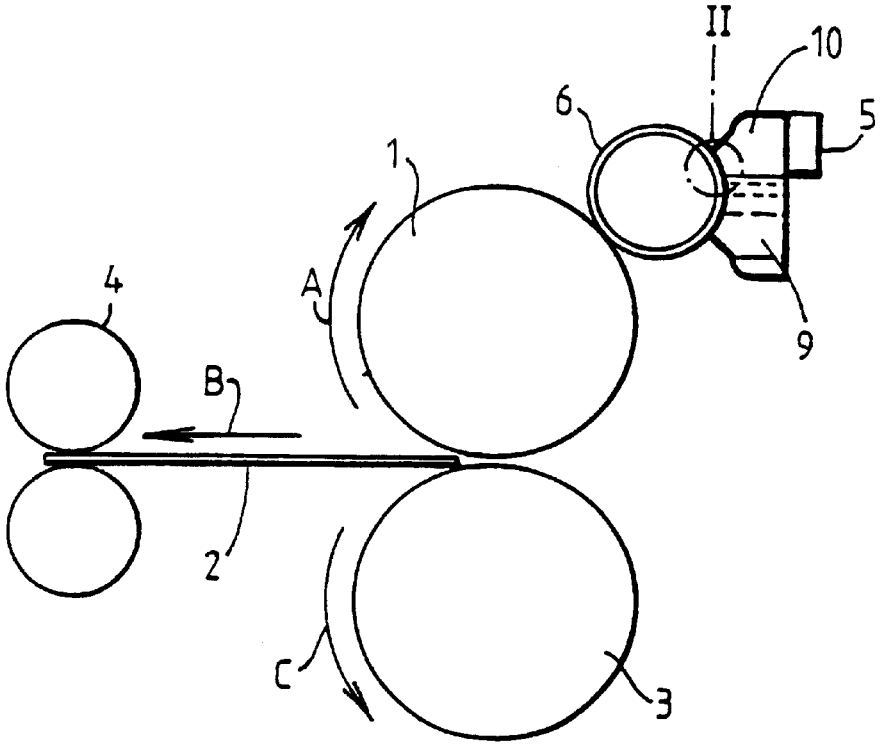
FIG. 1 is a side view of coating apparatus in accordance with the invention.

The coating apparatus as illustrated in FIG. 1 comprises a motor driven applicator roll 1 whose external smooth surface is free of grooves or other indentations and is typically coated with a plain-faced rubber-like compound, typically a nitryl rubber. The roll rotates in the direction indicated by arrow A. An electrical steel strip 2 moves continuously at around 60 m/min below and in contact with the surface of the roll 1 as it passes, for example, from an uncoiler positioned to the right of the drawing to a coiler positioned to the left of the drawing. The strip travels in the direction indicated by arrow B.

A support roll 3 is positioned immediately below the applicator roll 1, to support the electrical steel strip 2 as it passes continuously between the nip of the rolls 1 and 3. Minimal pressure is applied to the strip 2 by the rolls 1, 3. The support roll 3 rotates in the direction indicated by arrow C and may be raised or lowered to vary the spacing between the opposed surfaces of the rolls. One or more pairs of smoothing rolls 4 may be positioned downstream of the applicator roll in the direction of movement B of the strip. These smoothing rolls apply limited pressure to the coated strip to remove all surface irregularities therefrom. The applicator roll 1, support rolls 3 and smoothing rolls 4 may be controlled to rotate at a speed at or closely similar to the speed of travel of the electrical steel strip 2 to be coated.

Figure 2:
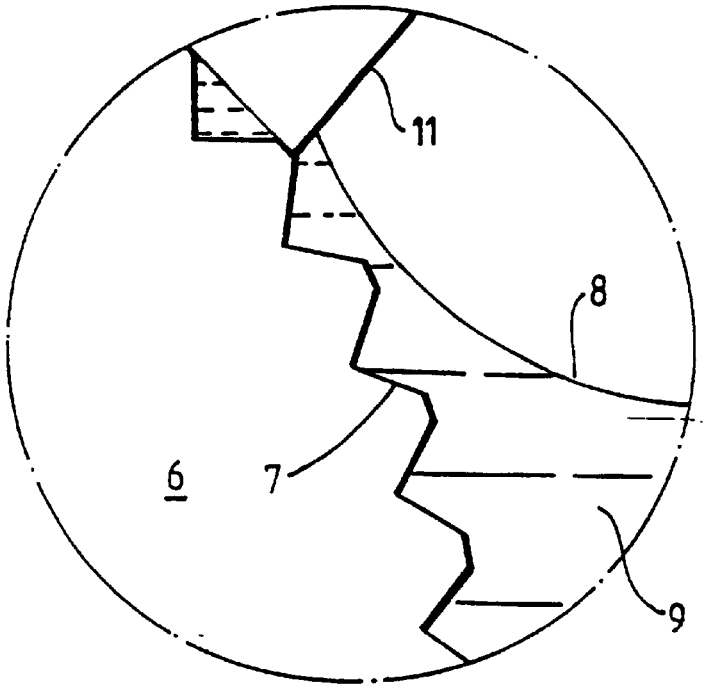
FIG. 2 is a detail to an enlarged scale of the coating apparatus illustrated in FIG. 1, the detail being indicated by circle II of FIG. 1.

Positioned to one side of and in contact with the applicator roll 1 is a metering roller 6 which operates to apply a uniform coating of UV curable insulating lacquer to the surface of the applicator roll 1. As will be seen from FIG. 2, the surface of the metering roller 6 is formed by engraving with a plurality of discrete cells 7 each capable of receiving and retaining a metered quantity of insulation lacquer 8 as the surface of the metering roller 6 passes through and is partially immersed in a bath 9 of lacquer held in a reservoir 10.

The reservoir 10 includes a heater 5 which is controlled to hold the temperature of the lacquer resident in the reservoir at between 40° C.–50° C. This ensures that the viscosity of the lacquer is sufficient to cause the lacquer to flow to fill the cells 7 and hence create a smooth insulating coating. The viscosity of the lacquer resident in the reservoir is typically between 5–10 poise. The heater 5 may form part of the reservoir as illustrated or may be positioned to heat the lacquer as it passes from a source to the reservoir. Pre-heating of the strip may also take place.

The lacquer is kept under pressure while resident within the reservoir to eliminate the occurrence of air bubbles within the lacquer. If present, these can lead to imperfections in the lacquer coating.

A scraper blade 11 removes from the surface of the roller 6 all excess lacquer thereby ensuring that only the required precise quantity of lacquer is conveyed by each cell 7 to the surface of the applicator roll 1. The thickness of the lacquer coating applied to the surfaces of the strip 2 can be varied simply by changing the cell depth and/or cell pattern and the number of cells per unit area. The metering roller can speedily be changed for cleaning or to enable a new roller to be installed with a different coating thickness capability.

Alternatively in order to reduce time when changing to a different coating thickness, which would normally require changing the etched metering roll, one or more additional plain rubber metering rolls may be added to enable transfer of lacquer from roll to roll resulting in the ability to produce a range of coating thickness with the same etched roll. Such an arrangement is illustrated in FIG. 3. In this arrangement, an intermediate transfer metering roller 15 is provided and is movable by a position control mechanism 16 into contact with the surface of the metering roller 6. When the roller 15 is in contact with the roller 6, the roller 16 is moved sideways by a position control mechanism 17 to a position where it is no longer in contact with the surface of the applicator roll 1. Thus, lacquer from the reservoir 10 is applied to the surface of applicator roll 1 via both metering rollers 6, 16. This enables a thinner coating of lacquer to be applied to the steel strip. Use of one additional metering roll for example has been shown to reduce the coating thickness from 1.7 microns to 1.0 microns.

In an unillustrated embodiment, the support roll 3 is replaced by an applicator roll supplied with lacquer from a metering roller in the same way in which metering roller 6 is supplied. In this embodiment, both surfaces of the strip 2 are coated simultaneously.

On leaving the smoothing rolls 4, the coated strip passes immediately to and through one or more drying chambers which house a series of ultra violet lamps positioned above, below or to one side of the or each coated surface of the moving strip.

The coating apparatus illustrated in FIG. 4 is similar to that shown in FIG. 1, and like integers have been given the same reference numerals. In this arrangement, the support roll 3 is replaced with an applicator roll 18 equivalent to applicator roll 1. Roll 18 is associated with a metering roller 19 equivalent to roller 6 which operates to apply a uniform coating of UV curable insulating lacquer to the surface of the roll 18, roller 19 taking lacquer from a reservoir 20 of such lacquer. The temperature of the lacquer resident in the reservoir 20 is controlled in the same way as described above in relation to FIG. 1.

Thus, both surfaces of a strip can simultaneously be coated using the apparatus illustrated in FIG. 4. The apparatus also includes means for moving the reservoirs out of contact with the respective rollers for cleaning, maintenance or replacement.

The coating apparatus of FIG. 5 is the same as that of FIG. 4 excepting that the strip passes vertically between the applicator rolls 1, 18.

Also, in FIG. 5 the drying chambers are positioned in line with the applicator rolls. Residence time of the strip within the UV drying chamber or chambers is typically between 0.5 and 1 second.

Typically a metering roller 6, 19 in accordance with this invention has approximately 375 cells per inch and typically produces a uniform coating of 1.7±0.1 g/m$^2$. Each roller 6, 19 may be produced with a copper/chrome or ceramic finish and may be reground and machined to produce a new cell pattern as often as required until the size of the roll becomes problematical. As mentioned the applicator roll 1, 18 is a plain ungrooved rubber roll. If used, the support roller 3 is a plain steel roll for single sided coating of the strip. Because the rolls 1, 18, 3 do not impose pressure on the strip 2, the incidence of roll damage is significantly reduced.

The lacquer 8 may be any one of a range of annealable or non-annealable UV curable lacquers, including those based on cationic resin systems, e.g. a basic resin with additions of say 1–3% talc or 20% phosphate by weight. Pigment may be added to colour the coating.

The lacquers typically have viscosities of around 20–500 Poise at 25° C. and includes additives, particularly if the cured coating is to be made anneal proof. Inorganic additives may be included to provide in the finished strip enhanced welding characteristics and annealability. The UV coated steels exhibit very good punchability characteristics.

Recent developments in UV coatings have eliminated the need for solvents. Curing of the lacquers is achieved by cross linking the polymers with UV light.

Modern UV coatings with a relatively low viscosity can have unpleasant odours associated with them. However the modern high viscosity lacquers of this invention have very little odour and do not therefore require expensive ventilation/extraction systems around the coating unit. Also the properties required for the electrical steel coatings are more easily achieved using high viscosity lacquers.

Energy consumption using UV curing systems is considerably less th an conventional thermal curing systems.

UV curable lacquers can be produced in virtually any color. Pigment additions m ay aid color coding of different products.

The application of lacquers in this invention, when applied thinly, does not suffer from oxygen inhibition.

There is effectively no effluent arising from the coatings and the only by-product is ozone from the UV lamps, this being removed to atmosphere by a conventional extraction system.

The method of this invention can be applied to any type of electrical steel irrespective of composition.

The following examples of trials conducted to test the performance and characteristics of the apparatus and methods discussed are given by way of example only.

Sample coatings were exposed to high humidity and showed very good resistance to corrosion despite less than 1 micron in thickness. Insulation resistance was also good, ranging from 1 to 40 ohms. These samples were in the non-annealed condition, and were tested using a standard Franklin insulation tester. For some samples, weldability proved satisfactory. Several samples were annealed to check annealability of the coatings. All the samples had good appearance. Coating weight results showed that it is possible to vary the coating weights through a relatively wide range. The electrical resistance was satisfactory with the highest resistance corresponding to the highest coating weight.

Welding trials showed the coatings to be weldable and were judged to be satisfactory and good. Various levels of talc were added to certain lacquer formulations to assess the effect on reducing the stickability after anneal at 800° C. and it was established that 2% talc additions were sufficient to prevent the samples sticking together after anneal.

In further trials, non annealable lacquer was applied to strip using a metering roll with 14.76 cells per mm (375 cells per inch). Acceptable thin coatings were achieved using this roll specification and the use of smoothing rolls enabled coatings with better appearance to be produced. Acceptable insulation resistance was noted for all the samples.

The effect of UV intensity on degree of cure was investigated. Even at low UV intensity (385 mJ/cm$^2$) of cure, good resistance to chemical attack was achieved, this being a method of assessing degree of cure.

Insulation resistance before anneal was found to be satisfactory.

One advantage of coated non-oriented electrical steels in accordance with the invention is that they can be cold reduced without damaging the integrity of the coating and continue to exhibit satisfactory insulation resistance after rolling.

The rollability of the UV cured coated steel strip has been proven following extension pass rolling of a plurality of strip products up to 9%.

In these rollability trials, non-oriented electrical steel strip was coated with various UV curable lacquers on a pilot line unit and coating thickness, resistance to chemical attack and insulation resistance of the coatings was evaluated. Various coated samples were given an extension pass of up to 9% using the cold reduction mill. Following cold reduction, the electrical insulation resistance of the sample was determined using the standard Franklin method of test, and detailed optical microscope observation of the coating was carried out.

The coatings on the samples employed for the cold reduction trials were as follows:

a) basic lacquer, high UV cure, strip pre-heated
b) basic lacquer, medium UV cure, strip pre-heated
c) basic lacquer, 1% talc, high UV cure
d) basic lacquer, 1% talc, high UV cure, smoothing roll in use
e) basic lacquer, 3% talc, high UV cure
f) basic lacquer, 3% talc, high UV cure, smoothing roll in use Following cold reduction the coating appearance of all the samples was considered to be excellent when observed by eye, or when observed in cross-section using an optical microscope, there being no apparent sign of the coating flaking or cracking away from the underlying steel surface, even at the highest extension pass of 9%.

The results of insulation measurements on the various samples in the non-annealed condition are given in Table 1.

It was found that the insulation resistance for the non-reduced steel was typically 5 ohms.cm$^2$ and that after an extension pass of 8% the insulation resistance was reduced to 1 ohms.cm$^2$.

For the various UV lacquer coated steel samples, it was shown that the insulation resistance fell to 0.5–1.0 ohms.cm$^2$ after an extension pass of >6%, the data for the samples for which a smoothing roll had been employed exhibiting the lowest values.

Typically, an extension pass of 6% is given to current commercially available material which also exhibits insulation values of 0.5 to 1.0 ohms.cm$^2$ at this % extension and this is considered adequate.

TABLE 1

Insulation resistance of UV cured lacquers on steel (extension pass - up to 9%)

| Sample Number | (Addition to basic lacquer) | % extension | Insulation Resistance (ohms · cm$^2$) | | | Average insulation |
|---|---|---|---|---|---|---|
| 1 | 3% talc high | 0 | 6.0 | 4.3 | 6.0 | 5.43 |
| 2 | UV cure | 1 | 6.3 | 3.0 | 2.9 | 4.07 |
| 3 | | 3 | 3.5 | 7.2 | 1.7 | 4.13 |
| 4 | | 5 | 0.9 | 2.1 | 1.2 | 1.40 |
| 5 | | 7 | 0.4 | 1.1 | 1.0 | 0.82 |
| 6 | | 9 | 0.7 | 0.3 | 1.0 | 0.66 |
| 7 | 1% talc high | 0 | 8.3 | 6.9 | 4.5 | 6.57 |
| 8 | UV cure with | 1.75 | 2.5 | 1.5 | 2.9 | 2.30 |
| 9 | smoothing roll | 4 | 1.5 | 3.8 | 0.9 | 2.05 |
| 10 | | 6 | 0.6 | 0.4 | 0.8 | 0.55 |
| 11 | 3% talc with | 0 | 1.9 | 3.5 | 2.6 | 2.67 |
| 12 | UV cure with | 1 | 2.8 | 2.9 | 1.6 | 2.43 |
| 13 | smoothing roll | 3 | 1.1 | 1.5 | 0.8 | 1.13 |
| 14 | | 5 | 1.1 | 0.6 | 0.8 | 0.82 |
| 15 | | 7 | 0.7 | 0.6 | 0.3 | 0.50 |
| 16 | | 9 | 0.3 | 0.5 | 0.3 | 0.37 |
| 17 | 1% talc high | 0 | 7.2 | 4.1 | 4.5 | 5.27 |
| 18 | UV cure | 1 | 1.5 | 1.7 | 1.5 | 1.57 |
| 19 | | 3 | 1.7 | 1.1 | 1.8 | 1.53 |
| 20 | | 5 | 0.8 | 2.6 | 0.7 | 1.37 |
| 21 | | 7 | 1.0 | 0.8 | 0.6 | 0.78 |
| 22 | | 9 | 0.3 | 0.3 | 0.4 | 0.30 |
| 23 | High UV cure | 0 | 5.3 | 11.4 | 3.8 | 6.83 |
| 24 | with stordy on | 2 | 4.3 | 2.9 | 2.2 | 3.13 |
| 25 | | 4 | 1.5 | 4.5 | 0.5 | 2.16 |
| 26 | | 6 | 0.8 | 0.8 | 1.2 | 0.93 |
| 27 | Medium UV | 2 | 2.8 | 3.8 | 4.5 | 3.70 |

TABLE 1-continued

| Insulation resistance of UV cured lacquers on steel (extension pass - up to 9%) | | | | | | |
|---|---|---|---|---|---|---|
| Sample Number | (Addition to basic lacquer) | % extension | Insulation Resistance (ohms · $cm^2$) | | | Average insulation |
| 28 | cure with | 4 | 1.8 | 1.8 | 0.8 | 1.47 |
| 29 | stordy on | 6 | 1.2 | 0.8 | 0.2 | 0.73 |
| 30 | | 8.5 | 0.4 | 0.6 | 0.2 | 0.39 |

NOTE: a) all at line speed of 10 m/min

It will be appreciated that the foregoing is merely exemplary of coating apparatus in accordance with the invention and that modifications can readily be made thereto without departing from the true scope of the invention as set out in the appended claims.

What is claimed is:

1. Apparatus for applying a coating of an insulation lacquer to a surface of a moving steel strip, comprising a rotatable metering roller whose surface defines a multiplicity of cells, a reservoir connected to receive controlled quantities of viscous organic or organic/inorganic insulating lacquer from a source of such lacquer, means for heating the lacquer resident in the reservoir, means for controlling the temperature of the lacquer resident in the reservoir before it is transferred to the metering roller, means for immersing part of the surface of the metering roller in a bath of said lacquer resident in the reservoir to cause said lacquer to enter the cells defined in the surface of the metering roller, means for imparting rotation to the metering roller, a rotatable applicator roll having a substantially plain surface free of grooves or other indentations, means for rotating the applicator roll with its surface in contact with the surface of the lacquer carrying metering roller whereby lacquer present in the cells of the metering roller is transferred to the surface of the applicator roll, and means for moving the steel strip to be coated continuously past and in contact with the applicator roll to apply a continuous uniform coating of lacquer to that surface.

2. Apparatus as claimed in claim 1, wherein at least one pair of smoothing rolls is positioned downstream of the applicator roll in the direction of movement of the strip.

3. Apparatus as claimed in claim 1, wherein a transfer roller is positioned between and in contact with surfaces of the metering roller and the applicator roll.

* * * * *